US007470175B2

(12) United States Patent
Sugahara et al.

(10) Patent No.: US 7,470,175 B2
(45) Date of Patent: Dec. 30, 2008

(54) COIN STACKING APPARATUS

(75) Inventors: Kazuma Sugahara, Himeji (JP); Yusuke Inuki, Himeji (JP)

(73) Assignee: Glory Kogyo Kabushiki Kaisha, Hyogo-Ken (JP)

( * ) Notice: Subject to any disclaimer, the term of this patent is extended or adjusted under 35 U.S.C. 154(b) by 552 days.

(21) Appl. No.: 10/694,048

(22) Filed: Oct. 28, 2003

(65) Prior Publication Data

US 2004/0132397 A1 Jul. 8, 2004

Related U.S. Application Data

(63) Continuation-in-part of application No. 10/070,141, filed as application No. PCT/JP01/05886 on Jul. 6, 2001, now abandoned.

(30) Foreign Application Priority Data

Jul. 7, 2000 (JP) ..... 2000-206703

(51) Int. Cl.
*G07D 9/06* (2006.01)

(52) U.S. Cl. ..... 453/61

(58) Field of Classification Search ..... 453/61, 453/62, 29, 30, 31; 53/447, 532, 212, 254
See application file for complete search history.

(56) References Cited

U.S. PATENT DOCUMENTS 1,260,382 A 3/1918 Hosking
1,278,349 A 9/1918 Hosking
1,784,707 A * 12/1930 Porter ..... 248/504
4,235,061 A * 11/1980 Watanabe et al. ..... 53/54
4,800,997 A * 1/1989 Ozeki et al. ..... 194/344
4,820,237 A 4/1989 Shinozaki et al.
4,832,655 A 5/1989 Sakurai
4,869,029 A 9/1989 Takatani et al.

(Continued)

FOREIGN PATENT DOCUMENTS

EP 0273746 7/1998

(Continued)

*Primary Examiner*—Patrick Mackey
*Assistant Examiner*—Mark Beauchaind
(74) *Attorney, Agent, or Firm*—Wenderoth, Lind & Ponack, L.L.P.

(57) ABSTRACT

A top end portion of an outer peripheral surface of a coin feeding roller protrudes in a stacking section as a rotating friction surface so as to correspond to an end portion of a coin passage. A plurality of coins are conveyed to the end portion of the coin passage in a row in a direction of a diameter of the coins by operation of a conveying mechanism. The rotating friction surface of the feeding roller rotates while contacting a lower surface of a conveyed coin, to cause the coin to get over the rotating friction surface from an upstream side to a downstream side of the friction surface with respect to a direction of rotation thereof. Thus, the roller displaces a trailing edge of a previously conveyed coin upwards so that a leading edge of a subsequently conveyed coin can enter between the previously conveyed coin and the friction surface. By repeating this operation, conveyed coins are sequentially stacked in a stacking section. A distance between an axis of the feeding roller and a stop surface of a stopping r, to which a leading edge of the coin contacts, is adjustable in accordance with a diameter of coins.

14 Claims, 11 Drawing Sheets

U.S. PATENT DOCUMENTS 4,951,448 A * 8/1990 Schmechel ..... 53/532
5,011,457 A * 4/1991 Takatani et al. ..... 453/61
5,142,847 A * 9/1992 Watanabe et al. ..... 53/532
5,389,034 A * 2/1995 Rumbach ..... 453/61
5,414,978 A 5/1995 Limousin
5,487,459 A * 1/1996 Farmont ..... 194/213

FOREIGN PATENT DOCUMENTS

JP 4-353995 A 12/1992

* cited by examiner

COIN STACKING APPARATUS

This application is a Continuation-In-Part Application of U.S. patent application Ser. No. 10/070,141, filed Mar. 4, 2002, now abandoned which was the National Stage of International Application No. PCT/JP01/05886, filed Jul. 6, 2001.

BACKGROUND OF THE INVENTION

1. Field of the Invention

The present invention relates to a coin stacking apparatus for use in a coin wrapping machine or the like, with the coin stacking apparatus being used for stacking coins, that have been conveyed in a coin passage one by one, in a row in a direction of thickness of the coins.

2. Description of Related Art

FIG. 13 shows a principal part of a conventional coin stacking apparatus. The coin stacking apparatus shown in FIG. 13 comprises a coin passage 1, a conveying mechanism 2, a coin stacking section 3', and a coin feeding member 140.

The coin passage 1 serves to guide a plurality of coins C in a row in a direction of diameter of the coins. The conveying mechanism 2 serves to convey the coins C along the coin passage 1 by a conveying belt 24. The coin stacking section 3' provided so as to correspond to an end portion of the coin passage 1 serves to stack the coins C that have been conveyed by the conveying mechanism 2, in a row in a direction of thickness of the coins. In this case, the coins C are conveyed in the coin passage 1 in a substantially horizontal direction to be stacked in the coin stacking section 3' substantially vertically upward.

The coin feeding member 140 serves to sequentially stack coins C that have been conveyed to the end portion of the coin passage 1, in the stacking section 3'. The feeding member 140 has a plurality of tooth portions 142 arranged in a circumferential direction, and is in the form of a toothed roller rotatable clockwise in FIG. 13. Each of the tooth portions 142 has a push surface 144 formed on an upstream side with respect to a direction of rotation of the feeding member 140 and extending in a substantially radial direction, and a lifting surface 146 formed on a downstream side with respect to a direction of rotation and extending in a substantially tangential direction.

If the push surface 144 of the tooth portion 142 is pressed by a leading edge of a conveyed coin C, the coin feeding member 140 is passively rotated by a driving force applied to the coin C. The coin feeding member 140 lifts a trailing edge of the coin C having been already fed in the stacking section 3', by the lifting surface 146 of the tooth portion 142 in accordance with rotation of the coin feeding member 140, so that a leading edge of a subsequently conveyed coin C can enter between lifted coin C and the feeding member 140. By repeating such an operation, a plurality of conveyed coins C are sequentially stacked in the stacking section 3'.

The coin stacking apparatus comprises a coin presser mechanism 151 for downwardly pressing an upper surface of an uppermost coin stacked in the stacking section 3'. The coin presser mechanism 151 has a lever 152 oscillatable around a shaft 155, and a contact roller 153 provided at a distal end of the lever 152.

The coin presser mechanism 151 also has a spring with a change point (not shown). The lever 152 on which the spring acts initially presses the uppermost coin downward via the roller 153, and after a predetermined number of coins are stacked in the stacking section 3', this pressing is released and the lever 152 greatly oscillates clockwise to be retracted from the stacking section 3'.

In the above described conventional coin stacking apparatus, there are the following problems. First, as shown in FIG. 14, it is assumed that a length of the tooth portion 142 of the coin feeding member 140 (a dimension from a tip of the tooth portion 142 to the push surface 144 of a next tooth portion 142 on the right) is T. Then, in case of a large-diameter coin C shown in FIG. 14(*a*), assuming that the diameter of the coin C is d1, in theory, if (d1/2)<T is not established, the coin C falls down to the left side, so that the lifting surface 146 cannot lift the coin C.

On the other hand, in case of a small-diameter coin C shown in FIG. 14(*b*), assuming that the diameter of the coin C is d2, in theory, if T<d2 is not established, the feeding member 140 can not completely rotate until a leading edge of a subsequent coin C is capable of entering between a preceding coin C and the feeding member 140. Finally, in theory, coins cannot be stacked by action of the coin feeding member 140 unless (d1/2)<T<d2 is established.

Therefore, d1<2×d2 is established as conditions for the coins, so that the coin feeding member 140 cannot cope with both first coins and second coins having diameters at least twice diameters of first coins, in theory. A diameter range of coins capable of being smoothly stacked by an actual apparatus is narrower than the above described theoretical range. Thus, in the conventional coin stacking apparatus using the toothed roller type feeding member 140, there are problems with respect to an adaptable range of diameters of coins.

SUMMARY OF THE INVENTION

The present invention has been made in view of the foregoing, and it is an object of the present invention to provide a coin stacking apparatus capable of increasing a range adapted to coins having different diameters.

In order to accomplish this object, according to the present invention, there is provided a first coin stacking apparatus comprising: a coin passage for guiding a plurality of coins in a row in a direction of diameter of the coins; a conveying mechanism for conveying the coins along the coin passage; a coin stacking section provided so as to correspond to an end portion of the coin passage, for stacking the coins that have been conveyed by the conveying mechanism, in a row in a direction of thickness of the coins; and a coin feeding member for sequentially stacking coins that have been conveyed to an end portion of the coin passage, in the stacking section. The feeding member has a contact portion protruding in a stacking section so as to correspond to the end portion of the coin passage, wherein the contact portion of the feeding member rotates while contacting a conveyed coin, to cause the coin to get over from an upstream side to a downstream side of the contact portion with respect to a direction of rotation thereof, to displace a trailing edge of the coin in the stacking direction so that a leading edge of a subsequently conveyed coin is capable of entering between a previously conveyed coin and the contact portion. A stopping member having a stop surface contacting a leading edge of the coin that has gotten over the contact portion is provided on a downstream side of the contact portion with respect to the direction of rotation thereof, and a distance between an axis of rotation of the contact portion of the feeding member and the stop surface of the stopping member is adjustable in accordance with diameter of the coins.

According to this coin stacking apparatus, if the leading edge of a conveyed coin that has been conveyed to the end portion of the coin passage by the conveying mechanism reaches the contact portion of the feeding member, the contact portion lifts a front edge of the conveyed coin to rotate the coin while contacting the coin, to cause the coin to get over the contact portion from the upstream side to the downstream side of the contact portion with respect to the direction of rotation thereof. Thus, the trailing edge of the previously conveyed coin (preceding coin) is displaced in the stacking direction so that the leading edge of the subsequently conveyed coin (subsequent coin) can enter between the preceding coin and the contact portion of the feeding member. Then, the subsequent coin entering between the preceding coin and the contact portion of the feeding member gets over the contact portion with rotation of the contact portion, in the same way as the preceding coin. By repeating the above described operation, a plurality of conveyed coins are sequentially stacked in the stacking section.

In the above described coin stacking apparatus, a distance between an axis of rotation of the contact portion of the feeding member and the stop surface of the stopping member is adjustable in accordance with the diameter of the coins. With such construction, the above described function of the feeding member for "displacing the trailing edge of the coin getting over the contact portion in the stacking direction" can be always surely performed in spite of a variation in diameter of the coin. Thus, it is possible to increase an adaptable range of diameters of coins.

According to the present invention, there is also provided a second coin stacking apparatus comprising: a coin passage for guiding a plurality of coins in a row in a direction of diameter of the coins; a conveying mechanism for conveying the coins along the coin passage; a coin stacking section provided so as to correspond to an end portion of the coin passage, for stacking the coins that have been conveyed by the conveying mechanism, in a row in a direction of thickness of the coins; and a coin feeding member for sequentially stacking the coins that have been conveyed to an end portion of the coin passage. In the stacking section, the feeding member has a contact portion protruding in the stacking section so as to correspond to the end portion of the coin passage, wherein the contact portion of the feeding member rotates while contacting a conveyed coin, to cause the coin to get over from an upstream side to a downstream side of the contact portion with respect to a direction of rotation thereof, to displace a trailing edge of the coin in the stacking direction so that a leading edge of a subsequently conveyed coin is capable of entering between a previously conveyed coin and the contact portion. The stacking section is configured to stack the coins substantially vertically upwards, and the coin stacking apparatus further comprises a coin presser mechanism for always downwardly pressing an upper surface of an uppermost coin stacked in the stacking section by dead weight.

According to this coin stacking apparatus, with such coin presser mechanism, a stacking failure due to rising of coins in the stacking section can be surely prevented until an end of stacking, unlike a conventional coin presser mechanism wherein pressing is released after a predetermined number of coins are stacked. Thus, it is possible to indirectly increase an adaptable range of diameters of coins.

From this point of view, also in the first coin stacking apparatus, it is preferable that the stacking section is configured to stack the coins substantially vertically upwards, and the coin stacking apparatus further comprises a coin presser mechanism for always downwardly pressing an upper surface of an uppermost coin stacked in the stacking section by dead weight.

The presser mechanism preferably has a presser member movable in a coin stacking direction while contacting an upper surface of an uppermost coin, and a weight member connected to the presser member via an elastic member. With such a construction, when a subsequent coin enters the stacking section to lift the presser member, an inertial force of the weight member acting on stacked coins via the presser member can be relieved by the elastic member. Thus, it is possible to allow the subsequent coin to easily enter the stacking section while securing a pressing function of the presser mechanism in its entirety by dead weight.

In each of the first and the second coin stacking apparatuses, a position of the feeding member with respect to the coin passage is preferably adjustable in accordance with the diameter of the coins. With such construction, the above described function of the contact portion of the feeding roller for "lifting the leading edge of the conveyed coin to rotate while contacting the coin, to cause the coin to get over the contact portion from the upstream side to the downstream side of the contact portion with respect to the direction of rotation thereof" can be more surely performed in spite of a variation in diameter of the coin.

DESCRIPTION OF THE PREFERRED EMBODIMENTS

Referring to the accompanying drawings, preferred embodiments of the present invention will be described. FIGS. 1 through 10 show preferred embodiments wherein a coin stacking apparatus according to the present invention is applied to a coin wrapping machine.

First Preferred Embodiment

First, referring to FIG. 1 through FIG. 8*b*, a first preferred embodiment of the present invention will be described. An entire construction, concrete constructions of respective sections, operation, function and effects of this preferred embodiment will be sequentially described below.

<Entire Construction>

Figure 3:
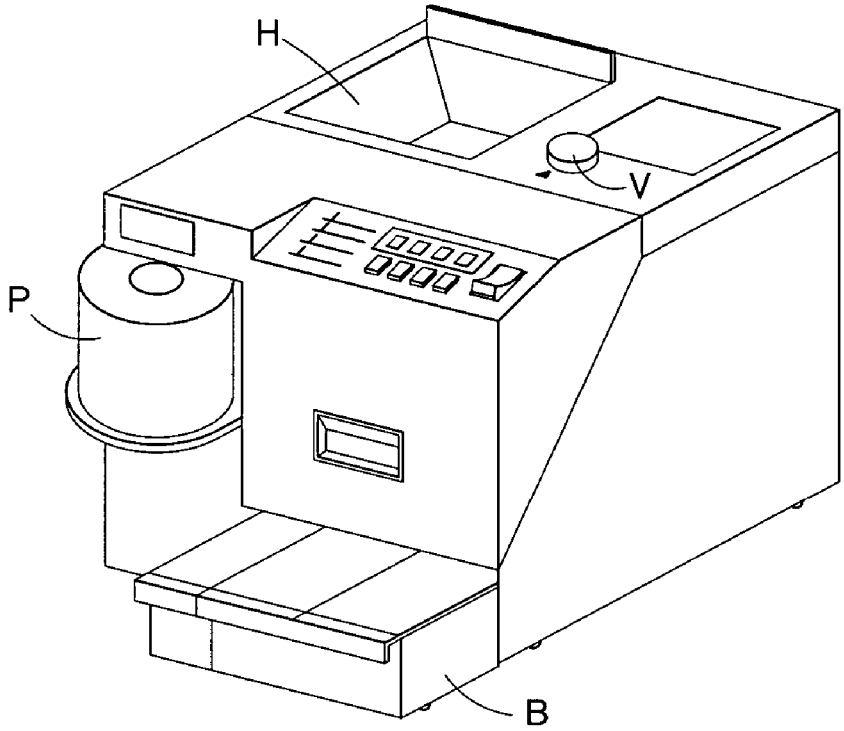
FIG. 3 is a perspective view showing an example of a coin wrapping machine including the coin stacking apparatus shown in FIG. 1.

FIG. 3 shows a coin wrapping machine including a coin stacking apparatus of this preferred embodiment. The coin wrapping machine shown in FIG. 3 has a hopper for receiving a new supply of coins, and a denomination setting dial V for setting a kind of coins, on an upper surface thereof. The coin wrapping machine has a wrapped coin box B for storing wrapped coins, on a lower front side. On a front side, a wrapping paper P for wrapping coins is mounted in the form of a roll.

Figure 4:
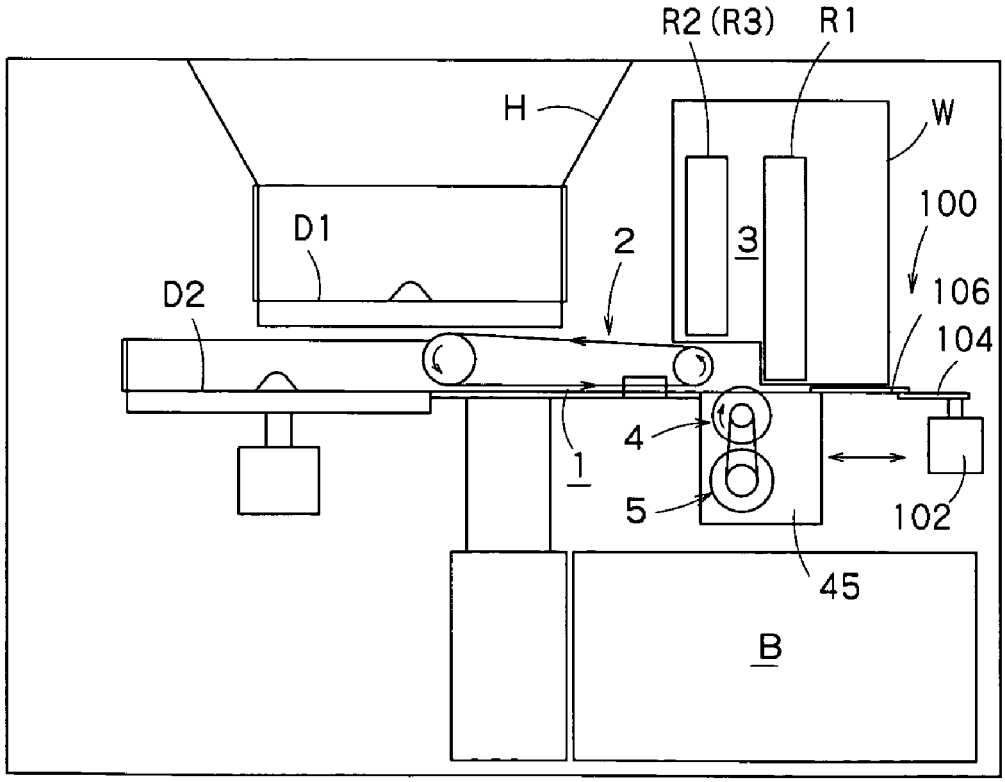
FIG. 4 is a simplified longitudinal sectional view of the coin wrapping machine shown in FIG. 3.
Figure 5:
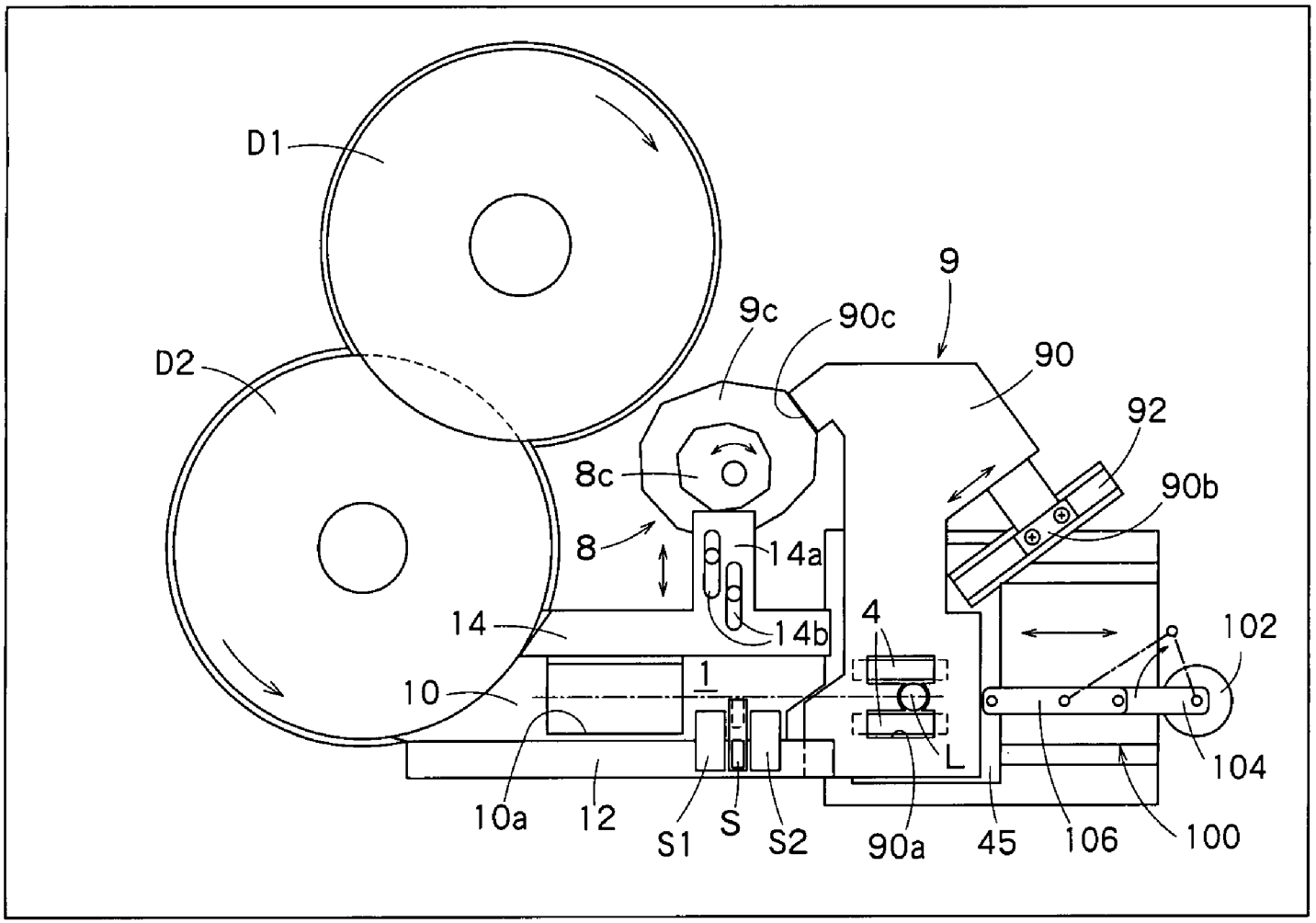
FIG. 5 is a simplified horizontal sectional view of the coin wrapping machine shown in FIG. 3.

FIGS. 4 and 5 schematically show an internal construction of the coin wrapping machine shown in FIG. 3. As shown in FIGS. 4 and 5, in the coin wrapping machine, a rotating disk D1 corresponding to the hopper H, and a rotating disk D2 adjacent to the rotating disk D1 are provided. A substantially horizontal coin passage 1 extending from the latter rotating disk D2 in a substantially tangential direction is also provided. The coin passage 1 is designed to guide a plurality of coins sequentially supplied from the rotating disk D2, in a row in a direction of diameter of the coins.

As shown in FIG. 4, there is provided a conveying mechanism 2 for conveying coins along the coin passage 1, and a coin stacking section 3 corresponding to an end portion of the coin passage 1. The coin stacking section 3 serves to stack coins that have been conveyed by the conveying mechanism 2, in a row in a direction of thickness of the coins (substantially vertically upward in this case).

The coin stacking section 3 is formed in a wrapping section W of the coin wrapping machine. Specifically, the coin stacking section 3 is formed between three wrapping rollers R1, R2 and R3 arranged in the wrapping section W. The wrapping section W is provided with a coin presser mechanism 7 (see FIGS. 1 and 2) for downwardly pressing the coins stacked in the stacking section 3, although it is not shown in FIG. 4.

Below the coin stacking section 3, a pair of coin feeding rollers (coin feeding members) 4 (see FIG. 5), and a driving system 5 for rotating the coin feeding rollers 4 are provided. The coin feeding rollers 4 serve to sequentially stack conveyed coins that have been conveyed to an end portion of the coin passage 1, in the stacking section 3. The wrapped coin box B is arranged below the coin stacking section 3, the feeding rollers 4 and the driving system 5.

As shown in FIG. 5, a passage width adjusting mechanism 8, a feeding roller position adjusting mechanism 9 and a retracting mechanism 100 are provided as a translational moving mechanism on a substantially horizontal plane. The width adjusting mechanism 8 serves to adjust a width of the coin passage 1 in accordance with the diameter of the coin. The position adjusting mechanism 9 serves to adjust a position of the feeding rollers with respect to the coin passage 1 in accordance with the diameter of the coin. The retracting mechanism 100 serves to retract the feeding rollers 4 and the driving system 5 from a position below the stacking section 3 when wrapped coins are caused to fall from the stacking section 3 into the wrapped coin box B.

<Concrete Constructions of Respective Sections>

Concrete constructions of the above described (1) coin passage 1, (2) wrapping section W including coin stacking section 3, (3) coin feeding rollers 4 and driving system 5, (4) coin presser mechanism 7, (5) passage width adjusting mechanism 8 and feeding roller position adjusting mechanism 9, and (6) retracting mechanism 100 will be sequentially described below.

(1) Coin Passage

As shown in FIG. 5, the coin passage 1 comprises a passage bottom plate 10, a fixed passage member 12 and a movable passage member 14. The passage bottom plate 10 is in the form of a substantially flat plate and has a rectangular coin dropping hole 10*a* in a central portion thereof. The dropping hole 10*a* serves to selectively drop a coin having a diameter smaller than that of a coin corresponding to a width of the passage.

The fixed passage member 12 is fixed to one side edge of the passage bottom plate 10. The movable passage member 14 is designed to move on the passage bottom plate 10 with respect to the fixed passage member 12 in lateral directions so as to adjust the width of the coin passage 1. Specifically, the variable passage member 14 has a protruding portion 14*a* protruding outward in a lateral direction of the passage, and is slidably guided in lateral directions of the passage by virtue of two long holes 14*b* formed in the protruding portion 14*a*.

On a side of the end portion of the coin passage 1, the fixed passage member 12 is sequentially provided with a passage sensor S1, a stopper S and a counting sensor S2. The counting sensor S2 serves to count a number of coins fed from the coin passage 1. The passage sensor S1 serves to detect passage of a coin of a predetermined ordinal number to cause the stopper S to enter the passage 1 to stop a subsequent coin.

(2) Wrapping Section Including Coin Stacking Section

Figure 1:
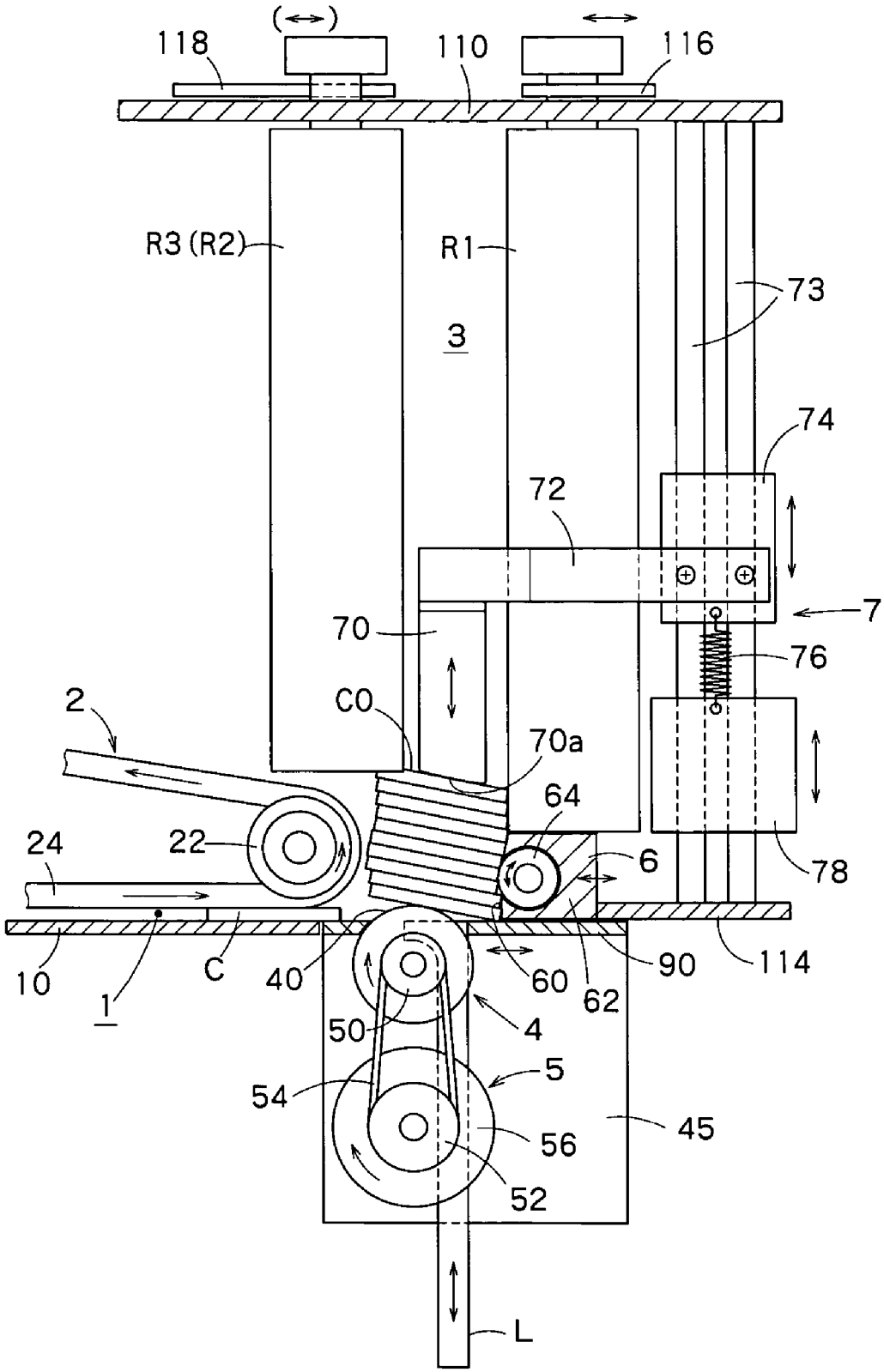
FIG. 1 is a longitudinal section showing a principal part of a first preferred embodiment of a coin stacking apparatus according to the present invention.
Figure 2:
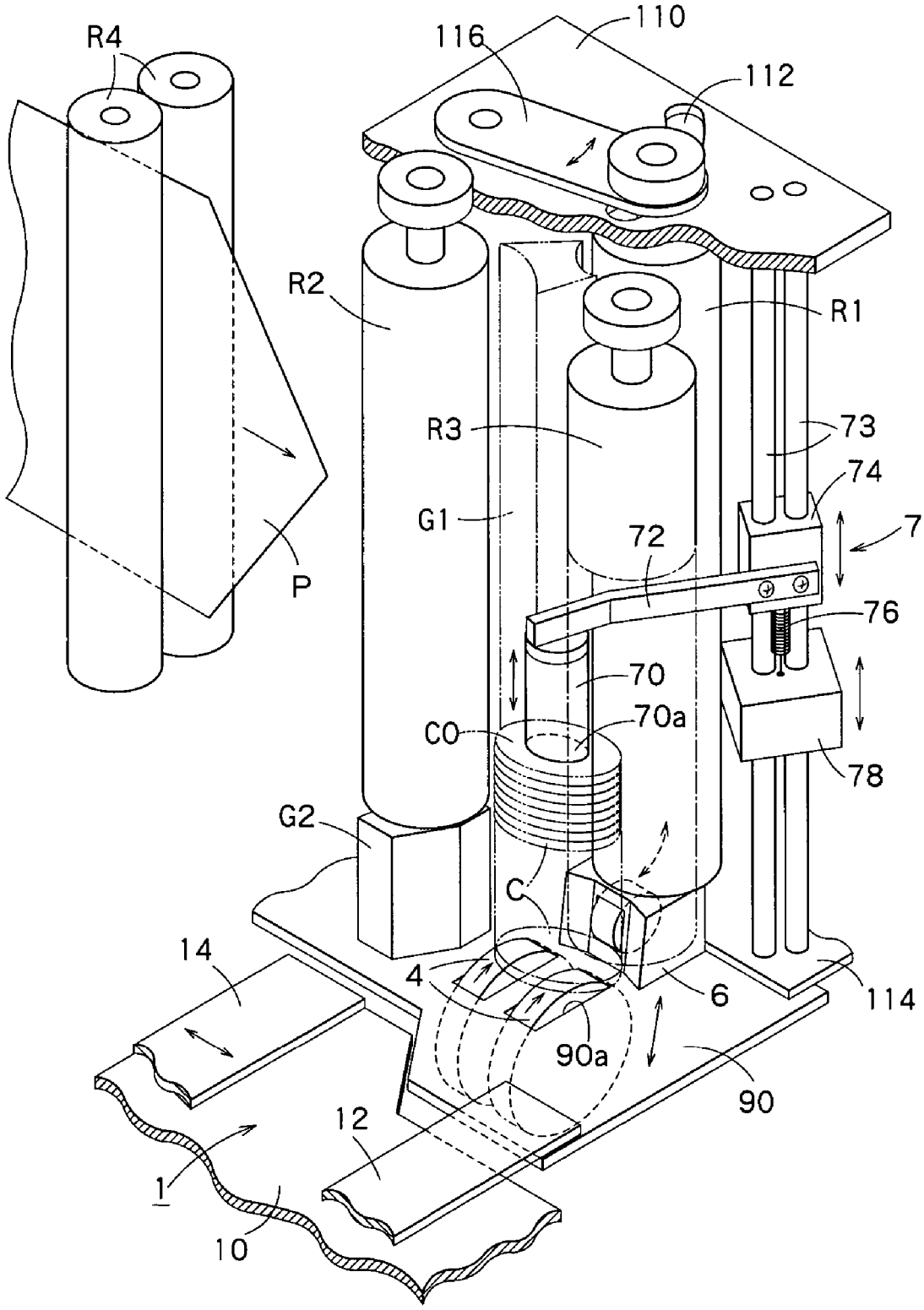
FIG. 2 is a perspective view corresponding to the principal part of the coin stacking apparatus shown in FIG. 1.

The wrapping section W including the coin stacking section 3 specifically has a structure shown in FIGS. 1 and 2. That is, the three wrapping rollers R1, R2 and R3 each having an axis of rotation extending in a substantially vertical direction are arranged at intervals in horizontal directions, and post-like guide members G1 are provided between the wrapping rollers R1, R2 and R3, respectively (only one guide member is illustrated in FIG. 2). Post-like space surrounded by the wrapping rollers R1, R2, R3 and the guide members G1 forms the coin stacking section 3.

The wrapping roller R1 arranged on a downstream side in a coin conveying direction (on the right side in FIG. 1) is movable along an arc-shaped slit 112 formed in a top board 110, in accordance with oscillation of a lever 116 connected to a top portion of the roller R1. Of the two wrapping rollers R2 and R3 arranged on an upstream side in the coin conveying direction (on the left side in FIG. 1), the wrapping roller R2 is movable in accordance with oscillation of a lever 118 (FIG. 1), in the same way as the wrapping roller R1, and the other wrapping roller R3 is fixed.

Below the wrapping roller R1, a stopping member 6 is provided. The stopping member 6 is designed to move with the wrapping roller R1 along the arc-shaped slit 112, and a direction of the stopping member 6 is constant regardless of rotation of the wrapping roller R1. The stopping member 6 has a stopping member body 62 having a contact surface 60, and a guide roller 64 movable in the body 62 (FIG. 1).

The contact surface 60 of the stopping member 6 is a substantially recessed cylindrical surface (FIG. 2), and is designed to contact a leading edge of a coin C passing over the coin feeding rollers 4. The guide roller 64 of the stopping member 6 slightly protrudes from the contact surface 60 to help vertical movement of the coin C along the contact surface 60.

As shown in FIG. 2, below the wrapping roller R2, a guide member G2 for guiding the coin C entering from the coin passage 1 is provided. Also below the wrapping roller R3, the same guide member (not shown) as the guide member G2 is provided symmetrically with respect thereto. A pair of wrapping paper rollers R4, R4 for feeding the wrapping paper P to the wrapping rollers R1, R2 and R3 is provided in parallel to the wrapping rollers R1, R2 and R3.

(3) Coin Feeding Rollers and Driving System

As shown in FIG. 1, an outer peripheral surface of each of the coin feeding rollers (coin feeding members) 4 constitutes a cylindrical rotating friction surface (contact portion) 40. At least the outer peripheral surfaces of the coin feeding rollers 4 are formed of friction material, such as urethane foam. Top end portions of the coin feeding rollers 4 are arranged so as to correspond to the end portion of the coin passage 1 to protrude into the stacking portion 3. In this case, as shown in FIG. 2, a flat-plate-like roller moving member 90 corresponding to a bottom portion of the coin stacking portion 3 is formed with an opening 90*a* through which the top end portion of each of the feeding rollers 4 protrudes upwards.

As will be described later, the rotating friction surfaces 40 of the feeding rollers 4 are designed to rotate while contacting a bottom surface of conveyed coin C, to cause the coin C to get over the surfaces 40 from the upstream side (left side in FIG. 1) to the downstream side (right side in FIG. 1) with respect to a direction of rotation thereof, to displace a trailing edge of the coin C upwards, i.e., in the stacking direction, so that a leading edge of a subsequently conveyed coin C can enter between the displaced coin C and the friction surfaces 40.

As shown in FIG. 1, the driving system 5 has two pulleys 50 and 52, and a belt 54 extending between the pulleys 50 and 52. The driving system 5 also has a motor 56 whose driving shaft is fixed to one pulley 52. The other pulley 50 is coaxially fixed to the feeding rollers 4 so that rotation of the motor 56 is transmitted to the feeding rollers 4 via the belt 54. In this case, the feeding rollers 4 are designed to be capable of freely rotating in a direction of rotation based on the driving system 5.

A rotation shaft of the feeding rollers 4 and the motor 56 are mounted on a supporting member 45 provided below the roller moving member 90. Between the pair of feeding rollers 4, a supporting rod L is arranged so as to pass through the roller moving member 90 to move upwards (see FIG. 5).

(4) Coin Presser Mechanism

As shown in FIGS. 1 and 2, the coin presser mechanism 7 has a presser member 70 contacting an upper surface of an uppermost coin C0 stacked in the stacking section 3. The presser member 70 has a cylindrical shape as a whole, and is arranged substantially in a center of the stacking section 3 parallel to the wrapping rollers R1 through R3. On a bottom end of the presser member 70, an inclined bottom face 70*a* is formed so as to correspond to a coin C obliquely stacked in the stacking section 3 (i.e. trailing edges of attacked coins C are lifted).

The presser member 70 is connected to a sliding member 74 via a lateral supporting member 72. A pair of guide rods 73, 73 extends substantially vertically between the top board 110 and a bottom board 114. Each guide rod 73 freely passes through the sliding member 74. Below the sliding member 74, a weight member 78, through which the pair of guide rods 73, 73 slidably passes, is arranged. The weight member 78 is connected to the sliding member 74 via a coil spring (elastic member) 76.

With this construction, the coin presser mechanism 7 is adapted to always (i.e. regardless of the number of stacked coins) downwardly press the upper surface of the uppermost coin C0 stacked in the stacking section 3, by the dead weight of the coin presser mechanism 7. In this case, the dead weight of the coin presser mechanism 7 means gravity acting on a total mass of the presser member 70, supporting member 72, sliding member 74, coil spring 76 and weight member 78 (providing, no vertical acceleration occurs).

(5) Passage Width Adjusting Mechanism and Feeding Roller Position Adjusting Mechanism In FIG. 5, as described above, the movable passage member 14 has the protruding portion 14*a* protruding outward in the lateral direction of the passage, and is slidably guided in the lateral directions of the passage. The width adjusting mechanism 8 has a biasing member (not shown), such as a spring, for biasing the movable passage member 14 outward in the lateral direction of the passage, and a cam 8*c* for passage width provided so as to correspond to a tip of the protruding portion 14*a* of the movable passage member 14.

The tip of the protruding portion 14*a* of the movable passage member 14 is designed to be pressed against a profile surface of the cam 8*c* for passage width by a biasing force of the biasing member. In this case, the profile of the cam 8*c* has a polygonal shape corresponding to diameters of a plurality of kinds of coins. That is, by moving the movable passage member 14 in the lateral directions of the passage by rotation of the cam 8*c*, the width of the coin passage 1 can be adjusted so as to correspond to the diameter of a coin.

The position adjusting mechanism 9 has a cam 9*c* for roller position provided so as to be coaxial with the cam 8*c* for passage width. Similar to the cam 8*c* for passage width, the cam 9*c* has a polygonal profile corresponding to the diameters of a plurality of kinds of coins. The roller moving member 90 is formed with a contact portion 90*c* corresponding to the cam 9*c*.

The roller moving member 90 is provided with a sliding portion 90*b*. On the other hand, an oblique guide member 92 is mounted on the supporting member 45. By the oblique guide member 92, the sliding portion 90*b* is slidably guided obliquely between a lower-left side and an upper-right side by about 45 degrees in FIG. 5. A biasing member (not shown), such as a spring, is provided for biasing the roller moving member 90 obliquely toward the lower-left side. Thus, the contact portion 90*c* of the roller moving member 90 is adapted to be pressed against the profile surface of the cam 9*c* by a biasing force of the biasing member.

That is, by moving the roller moving member 90 in a guiding direction due to the oblique guide member 92 by rotation of the cam 9*c* synchronized with the cam 8*c*, a position of the feeding rollers 4 with respect to the coin passage 1 can be adjusted so as to correspond to the diameter of the coin (as will be described later).

The cam 8*c* for passage width and the cam 9*c* for roller position should not be limited to the above described cams having the polygonal profile, but the cams may be a step-less cam having a curved profile.

(6) Retracting Mechanism

As shown in FIGS. 4 and 5, the retracting mechanism 100 has a motor 102, a driving link 104 and a driven link 106. A proximal end of the driving link 104 is connected to a driving shaft of the motor 102, and a distal end of the driving link 104 is connected to one end of the driven link 106. Another end of the driven link 106 is connected to the supporting member 45. The supporting member is slidably guided between the right side and the left side of FIGS. 4 and 5.

Therefore, the driving link 104, the driven link 106 and the supporting member 45 form a slider-crank mechanism, and the supporting member 45 (together with the oblique guide member 92 and the roller moving member 90) can be moved by rotation of the motor 102 between the right side and the left side of FIGS. 4 and 5.

<Operation/Function>

An operation/function of this preferred embodiment with such constructions will be described. (1) The operation/function during stacking of coins, (2) the operation/function with respect to wrapping of stacked coins, and (3) the operation/function during changing of denomination of coins will be sequentially described below.

(1) Operation/Function during Staking of Coins

First, referring to FIG. 6, the operation/function during the stacking of coins in the stacking section 3 will be described below.

Figure 6:
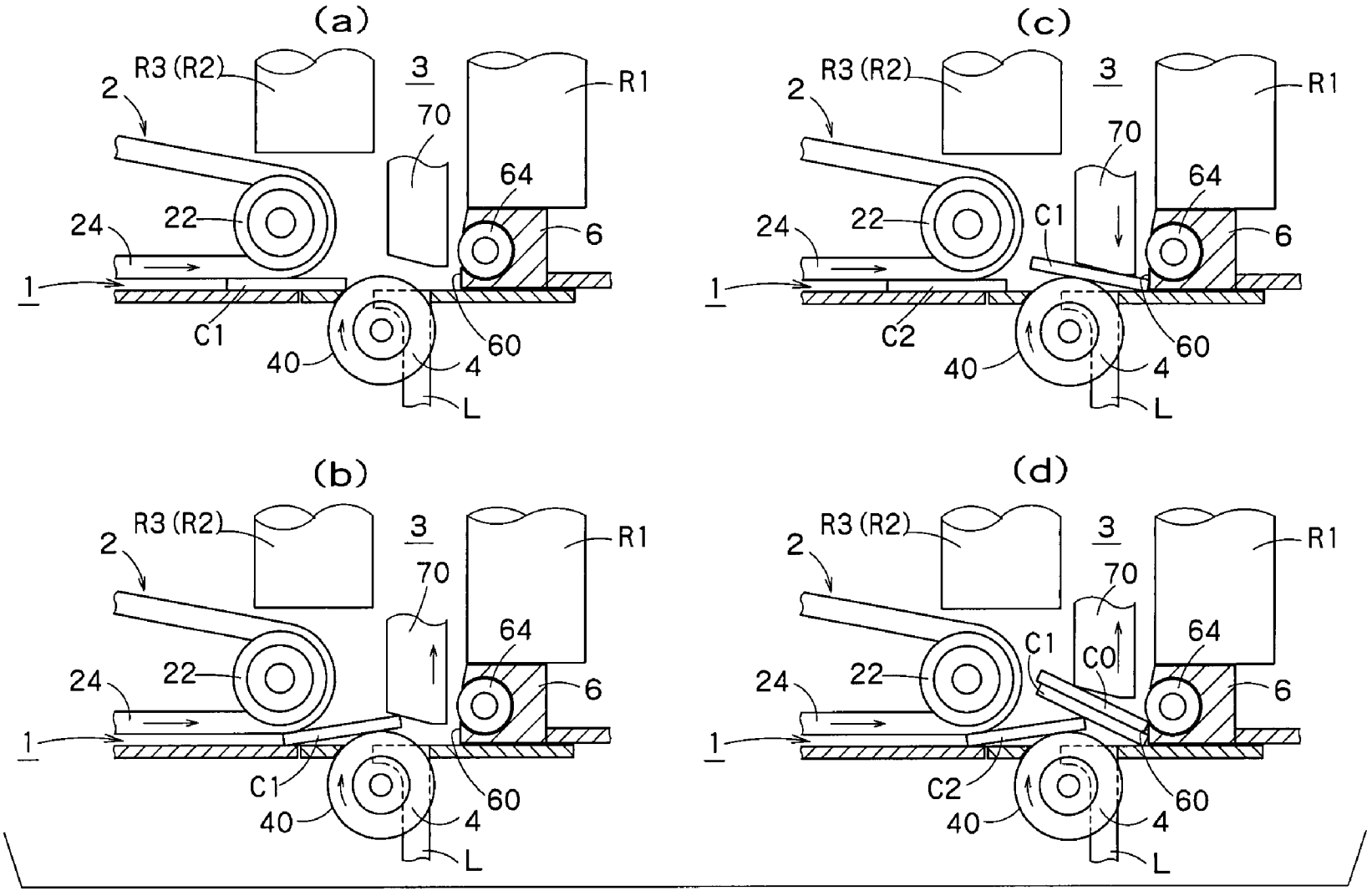
FIG. 6 is a diagram showing a coin stacking operation of the coin stacking apparatus shown in FIG. 1, in order of (a) through (d)

FIG. 6(*a*) shows a state that a leading edge of a conveyed coin C1, which has been conveyed to the end portion of the coin passage 1 by the conveying belt 24 of the conveying mechanism 2, reaches the rotating friction surfaces 40 of the feeding rollers 4. From this state, the friction surfaces 40 lift a front edge of the conveyed coin C1 to rotate the coin while contacting a lower surface of the coin C1 (FIG. 6(*b*), to cause the coin C1 to get over the friction surfaces 40 from an upstream side to a downstream side of the friction surface with respect to a direction of rotation (FIG. 6(*c*)).

Thus, a trailing edge of a previously conveyed coin (preceding coin) C1 is displaced in a stacking direction so that a leading edge of a subsequently conveyed coin (subsequent coin) C2 can enter between the coin C1 and the friction surfaces 40 of the feeding rollers 4.

Then, the subsequent coin C2, which has entered between the preceding coin C1 and the friction surfaces 40 of the feeding rollers 4, also gets over the friction surfaces 40 in accordance with rotation of the friction surfaces 40, in the same way as the preceding coin C1 (FIG. 6(*d*), showing a state that the subsequent coin C2 as a third conveyed coin is fed below the preceding coin C1 as a second conveyed coin, by jumping by one coin from the state after FIG. 6(*c*)).

By repeating the above described operation, a plurality of conveyed coins are sequentially stacked in the stacking section (for example, as shown in FIGS. 1 and 2). Meanwhile, the coin presser mechanism 7 always presses the upper surface of the uppermost coin C0 stacked in the stacking section 3 by dead weight thereof (via the bottom face 70*a* of the presser member 7).

Assuming that a set number of coins to be stacked in the coin stacking section 3 is X (e.g. X=50), the coin stacking operation ends as follows. That is, if the counting sensor S2 shown in FIG. 5 counts the (X−1)-th (forty-ninth) coin and if the passage sensor S1 detects the passage of the next X-th (fiftieth) coin, the stopper S enters the coin passage 1. Immediately thereafter, conveyance of the coins by the conveying mechanism 2 and rotation of the coin feeding rollers 4 are stopped, and the operation for stacking the X coins ends.

(2) Operation/Function with respect to Wrapping of Stacked Coins

Referring to FIGS. 1, 2, 4 and 5, the operation/function with respect to the wrapping of stacked coins will be briefly described below.

First, after a predetermined number of coins are stacked in the coin stacking section 3, the supporting rod L shown in FIG. 1 presses these stacked coins from a bottom to lift the coins to a predetermined coin wrapping position. In accordance therewith, the stacked coins stacked stairs-wise in an oblique state, are arranged so as to be horizontal. Then, by moving the wrapping rollers R1 and R2 by operation of the levers 116 and 118 shown in FIGS. 1 and 2, the three wrapping rollers R1, R2 and R3 are caused to relatively approach each other to clamp the stacked coins.

Then, by rotation of the three wrapping rollers R1, R2 and R3, the stacked coins are rotated. By utilizing this rotation, the wrapping paper P (FIG. 2) fed by the pair of wrapping rollers R4, R4 is wound onto the stacked coins from between the two wrapping rollers R1 and R2. Top and bottom ends of this wound wrapping paper P is caulked by a predetermined caulking system (not shown). At this point, the supporting rod L is retracted downwards.

Then, by operation of the retracting mechanism 100 shown in FIGS. 4 and 5, the feeding rollers 4 and the driving system 5, together with the supporting member 45, the oblique guide member 92 and the roller moving member 90, are retracted to the right in FIGS. 4 and 5. After this retraction is completed, by releasing clamping of the coins between the wrapping rollers R1, R2 and R3, the wrapped coins drop into the wrapped coin box B from the stacking section 3 (via, e.g., a chute (not shown)).

(3) Operation/Function during Change of Denomination

Referring to FIGS. 2, 5 and 7*a* through 8*b*, the operation/function during a change of denomination for coins having different diameters will be described. This denomination changing operation is mechanically or electrically performed on the basis of operation of, e.g., the denomination setting dial V in the coin wrapping machine shown in FIG. 3 (or a switch such as another push button).

First, in FIG. 5, the width of the coin passage 1 is adjusted so as to correspond to the diameter of the coin, by rotating the cam 8*c* for passage width to a rotational position corresponding to the diameter of the coin, to move the movable passage member 14 in the lateral direction of the passage.

Figure 7A:
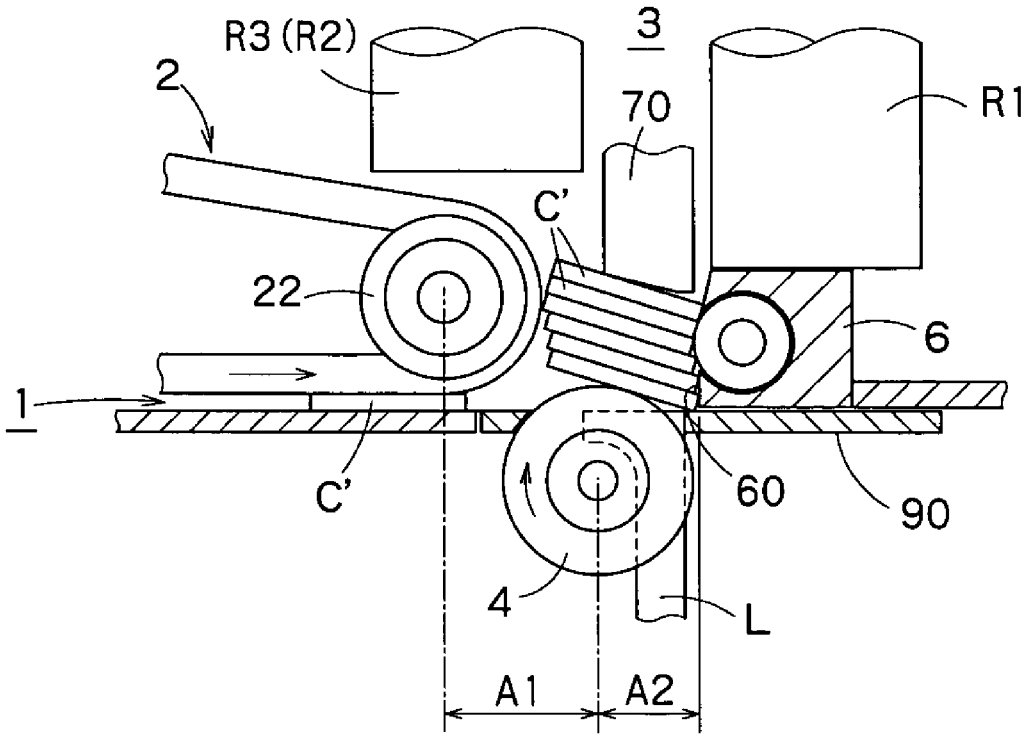
FIG. 7*a* is a diagram showing a coin feeding roller and a stopping member of the coin stacking apparatus shown in FIG. 1, at a position corresponding to a small-diameter coin.
Figure 7B:
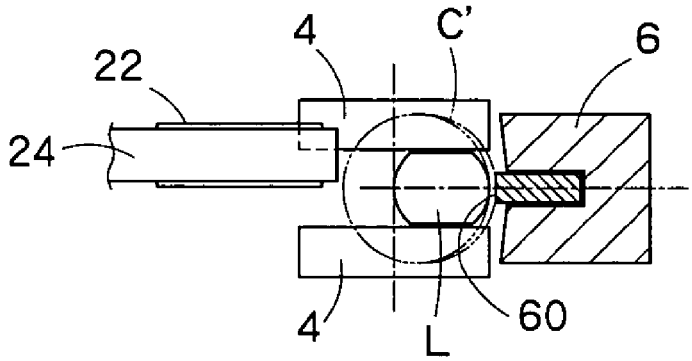
FIG. 7*b* is a plan view showing a principal part of FIG. 7*a* and showing a part thereof as a horizontal section.
Figure 8A:
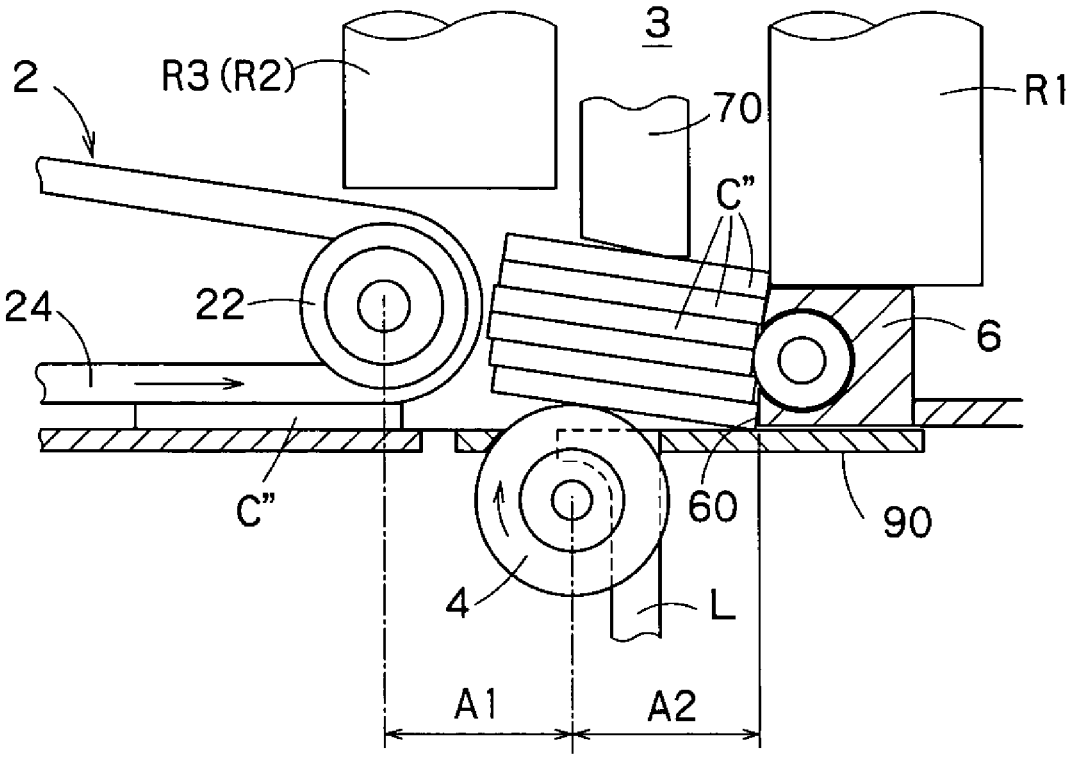
FIG. 8*a* is a diagram similar to FIG. 7*a* when corresponding to a large-diameter coin.
Figure 8B:
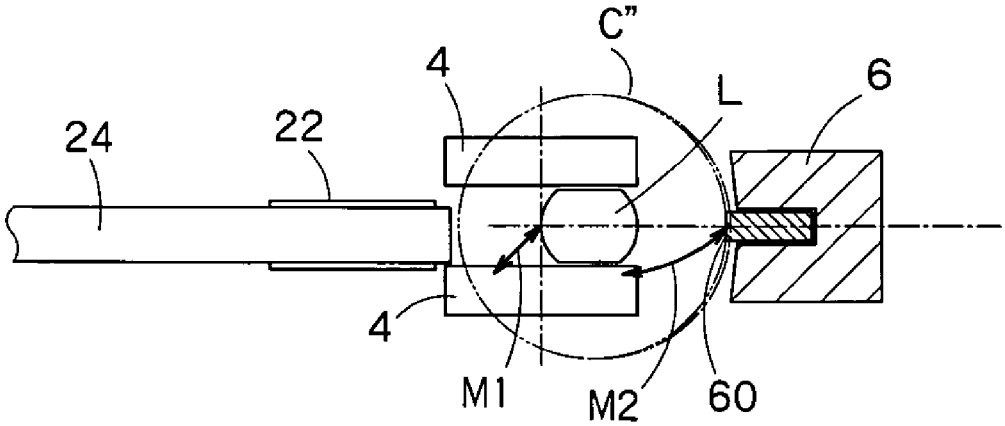
FIG. 8*b* is a diagram similar to FIG. 7*b* when corresponding to a large-diameter coin.

Then, with respect to positions of the coin feeding rollers 4 and the stopping member 6, FIGS. 7*a* and 7*b* show positions corresponding to a small-diameter coin C', and FIGS. 8 and 8*b* show positions corresponding to a large-diameter coin C". FIGS. 7*a* and 8*a* show a distance A1 between centers of the pulley 22 of the conveying mechanism 2 and the feeding rollers 4, and a distance A2 between a center of the feeding rollers 4 and the stopping surface 60 of the stopping member 6.

FIGS. 7*b* and 8*b* show a relationship in horizontal positions of the feeding roller 5 and the stopping member 6 with respect to the pulley 22. In particular, FIG. 8*b* shows a moving locus of a central position with respect to the pair of feeding rollers 4 by arrow M1, and a moving locus of a center of the stopping surface 60 of the stopping member 6 by arrow M2.

First, in FIG. 5, a position of the feeding rollers 4 is adjusted to a position corresponding to the diameter of the coin, by rotating the cam 9*c* for roller position (together with the cam 8*c* for passage width) to a rotational position corresponding to the diameter of the coin to move the roller moving member 90 in the guiding direction due to the oblique guide member 92 (in the direction of arrow M1 in FIG. 8*b*). Specifically, the distance A1 shown in FIGS. 7*a* and 8*a* increases or decreases in accordance with the diameter of the coin, and the position of the feeding rollers 4 in the lateral directions of the passage is shifted. As shown in FIG. 5, the latter position in lateral directions of the passage is moved in accordance with movement of the movable passage member 14 so that the feeding rollers 4 are always positioned substantially on a center line of the coin passage 1.

Then, in FIG. 2, a position of the stopping member 6 (together with the wrapping roller R1) is adjusted to a position corresponding to the diameter of the coin by oscillating the lever 116 to an oscillating position corresponding to the diameter of the coin. Specifically, the distance A2 from the feeding rollers 4 shown in FIGS. 7*a* and 8*a* increases or decreases in accordance with the diameter of the coin, and a position of the stopping member 6 in the lateral direction of the passage is also shifted. As shown in FIGS. 7*b* and 8*b*, the latter position in the lateral direction of the passage is moved so that the stopping member 6 always substantially corresponds to the position of the feeding rollers 4.

Accordingly, it may be seen from the above described structure and operation that the positions of the coin feeding rollers 4 and the stopping member 6 relative to the coin passage 1 are adjustable in horizontally longitudinal and lateral directions of the coin passage 1 in accordance with the diameter of the coins, the coin feeding rollers 4 and the stopping member 6 being positioned substantially on a center line of the coin passage. See also the plan view of FIG. 5.

<Effects>

Effects provided by this preferred embodiment will be described below.

According to this preferred embodiment, as described above, coins can be stacked by operation of the feeding rollers 4 each having the cylindrical rotating friction surface 40 in place of a conventional toothed roller. For that reason, it is possible to avoid functional restrictions caused by a relationship between a length of a tooth and a diameter of the coins in a conventional toothed roller, and to increase an adaptable range of diameters of coins.

Since the friction surfaces 40 of the feeding rollers 4 can be positively rotated by the driving system 5, it is possible to avoid an engagement between peripheral grooves of the coins due to the pressing of the coins to each other in a direction of diameter of the coins, such as a case where the friction surfaces 40 of the feeding rollers 4 are passively rotated by the driving force applied to conveyed coin C. The term "peripheral groove" means circular groove formed in a peripheral surface of a coin, such as a Euro two cent coin.

By adjusting a position of the feeding rollers 4 with respect to the coin passage 1 in accordance with the diameter of the coin by the position adjusting mechanism 9, the above described function of the friction surfaces 40 of the feeding rollers 4 for "lifting the leading edge of the conveyed coin to rotate while contacting the lower surface of the coin, to cause the coin to get over the friction surfaces 40 from the upstream side to the downstream side of the friction surface 40 with respect to the direction of rotation thereof" can be always surely performed in accordance with a variation in diameter of the coin.

Since the distance A2 between the center of the feeding rollers 4 and the contact surface 60 of the stopping member 6 can be adjusted so as to correspond to the diameter of the coin, the above described function of the feeding rollers 4 for "displacing the trailing edge of the coin C getting over the rotating friction surfaces 40 upwards (in stacking direction)" can be always surely performed in spite of the variation in diameter of the coin.

Since the coin presser mechanism 7 for always pressing the upper surface of the uppermost coin C0 stacked in the stacking section 3 by dead weight thereof (regardless of the number of stacked coins) is provided, stacking failure due to rising of coins in the stacking section 3 can be surely prevented to the end, unlike a conventional coin presser mechanism wherein pressing is released after a predetermined number of coins are stacked. When the stacked coins are lifted to the coin wrapping position by the supporting rod L, shifting and dropping of the stacked coins can be surely prevented by clamping the stacked coins from bottom and top by the supporting rod L and the coin presser mechanism 7.

According to this presser mechanism 7, when a subsequent coin enters the stacking section 3 to lift the presser member 70, an inertial force of the weight member 78 acting on the stacked coins via the presser member 70 can be relieved by the coil spring 76. Thus, it is possible to allow the subsequent coin to easily enter the stacking section while securing the pressing function of the entire presser mechanism 7 by dead weight.

Second Preferred Embodiment

Figure 9:
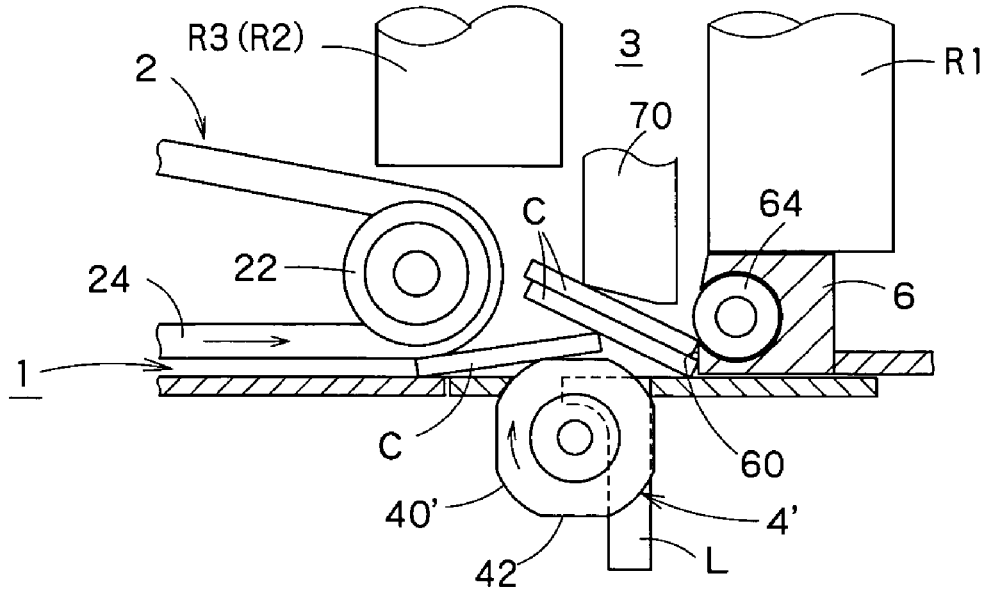
FIG. 9 is a longitudinal section showing a principal part of a second preferred embodiment of a coin stacking apparatus according to the present invention.

Referring to FIG. 9, a second preferred embodiment of the present invention will be described below.

<Construction>

As shown in FIG. 9, this preferred embodiment is different from the above described first preferred embodiment in that coin feeding rollers 4' having uneven rotating friction surfaces 40' (with irregularities) is provided in place of the above described coin feeding rollers 4, and other constructions are the same as those in the above described first preferred embodiment shown in FIGS. 1 through 8.

Specifically, as shown in FIG. 9, the rotating friction surfaces 40' of the coin feeding rollers 4' in this preferred embodiment are uneven by forming a plurality of substantially flat chamfered portions 42 at intervals in circumferential directions. In place of such chamfered portions 42, any protruding portions and recessed portions may be formed at intervals in circumferential directions, or a shape of the friction surface in its entirety may be a regular polygon, such as a regular dodecagon.

<Functional Effects>

Functional effects of this preferred embodiment with such constructions will be described. According to this preferred embodiment, by applying vibrations to coin C by irregularities of the rotating friction surfaces 40', an interference state, such as an engagement between coins C, can be easily released to ensure a smooth stacking operation. As such an engagement between the coins C, engagement of surface relief of one coin with a periphery of another coin is considered in addition to the above described engagement between peripheral grooves of the coins.

Third Preferred Embodiment

Figure 10:
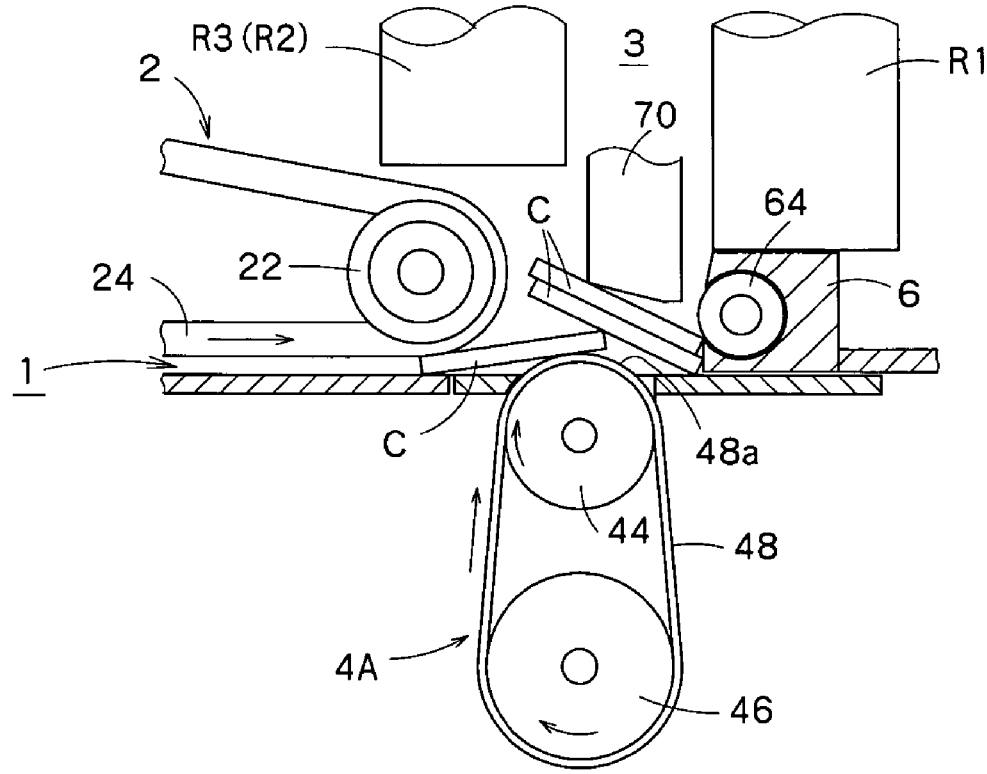
FIG. 10 is a longitudinal section showing a principal part of a third preferred embodiment of a coin stacking apparatus according to the present invention.
Figure 11A:
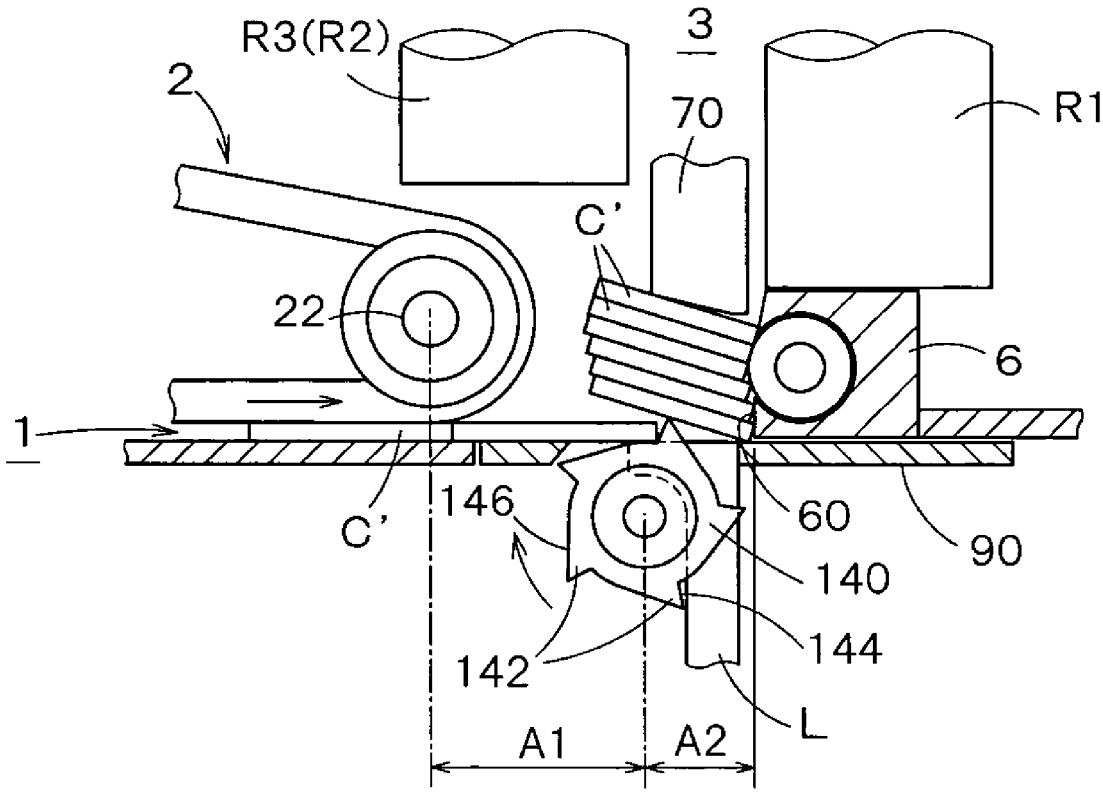
FIG. 11*a* is a diagram showing a toothed roller and a stopping member of a fourth preferred embodiment of a coin stacking apparatus according to the present invention, at a position corresponding to a small-diameter coin.
Figure 11B:
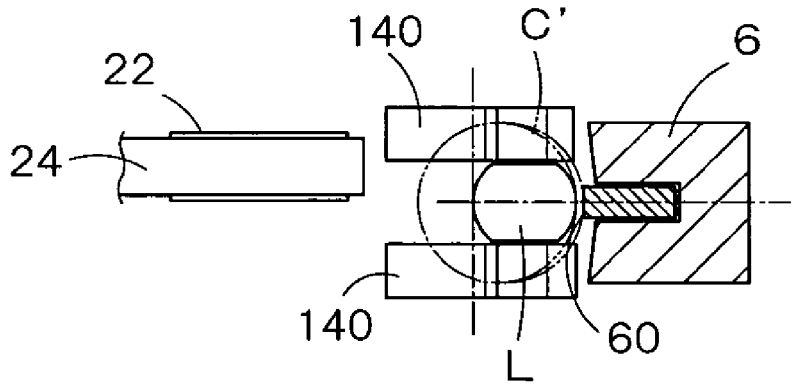
FIG. 11*b* is a plan view showing a principal part of FIG. 11*a* and showing a part thereof as a horizontal section.
Figure 12A:
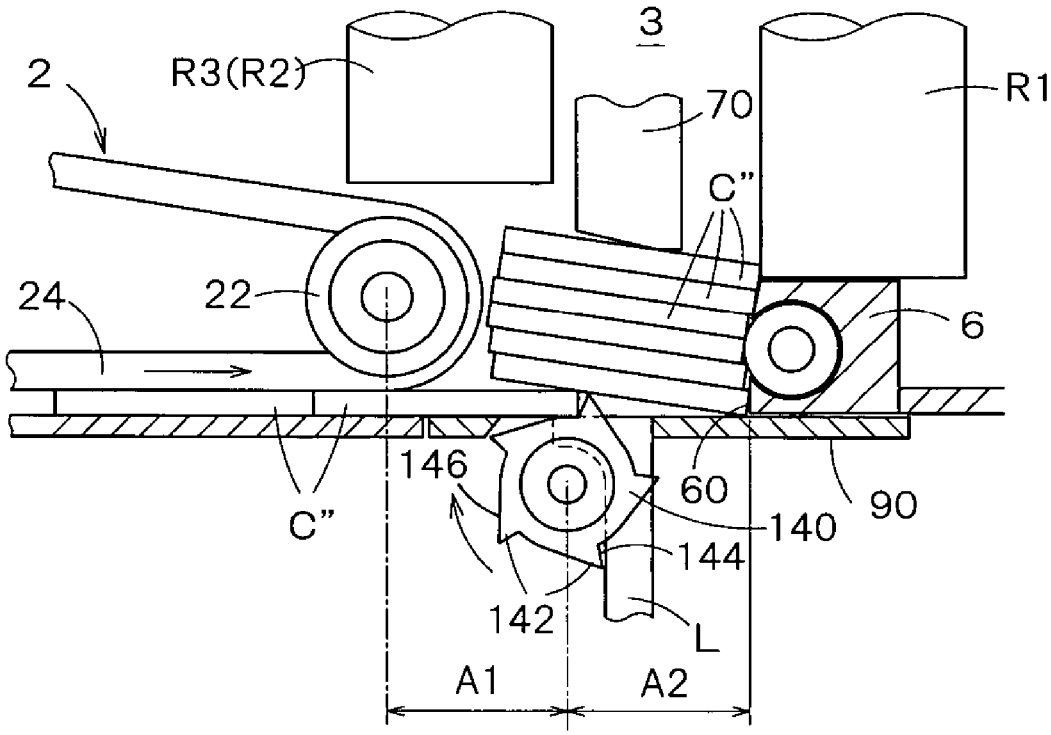
FIG. 12*a* is a diagram similar to FIG. 11*a* when corresponding to a large-diameter coin.
Figure 12B:
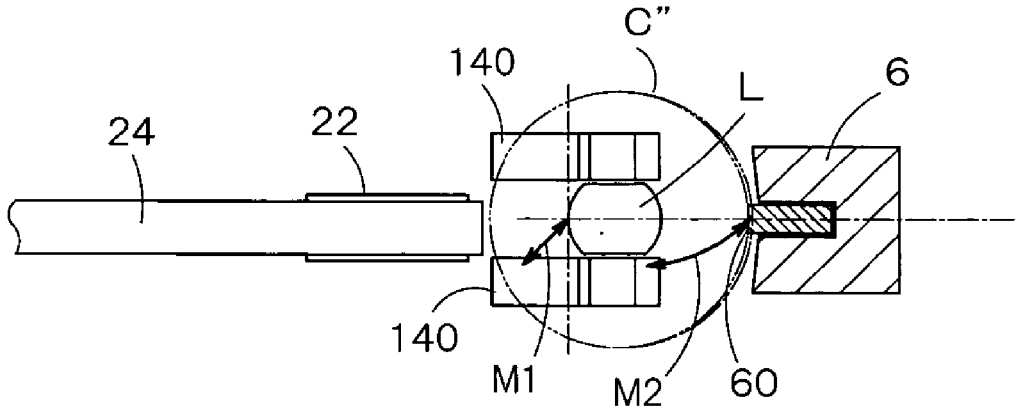
FIG. 12*b* is a diagram similar to FIG. 11*b* when corresponding to a large-diameter coin.
Figure 13:
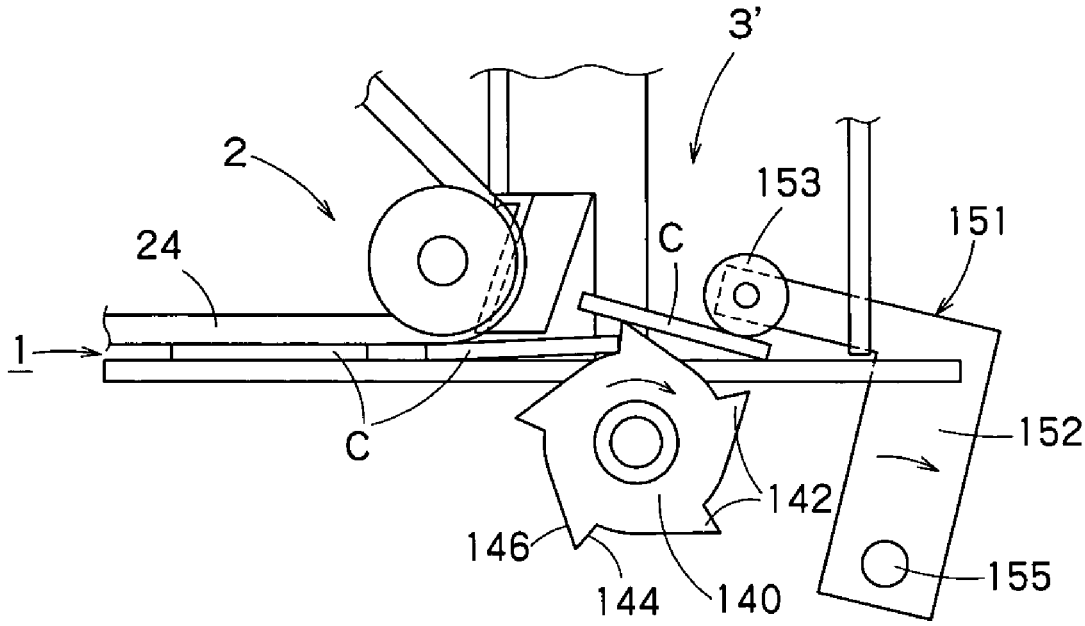
FIG. 13 is a diagram showing a principal part of a conventional coin stacking apparatus.
Figure 14:
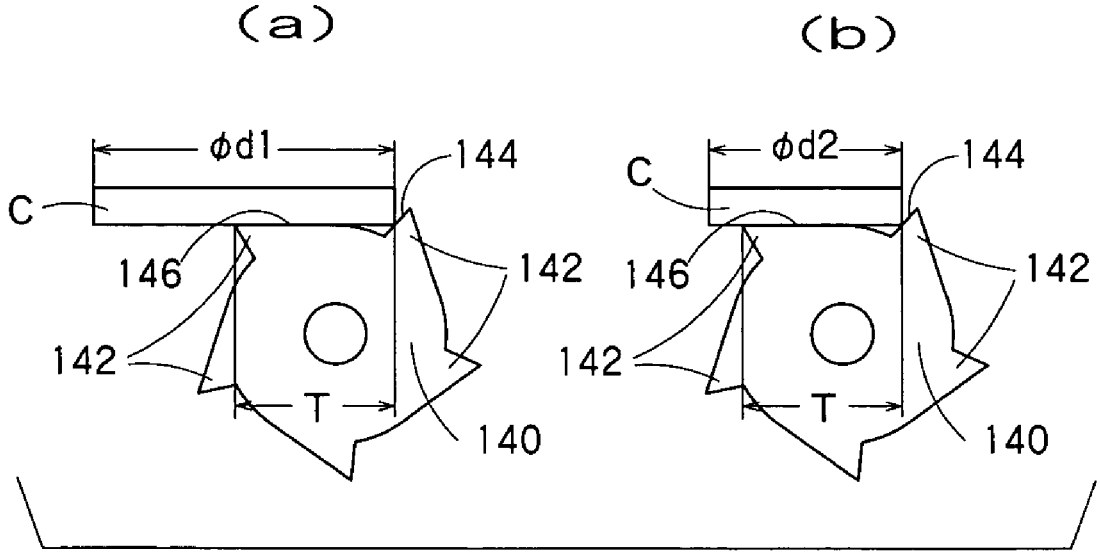
FIG. 14 is a diagram showing a relationship between a coin feeding member and a coin in the coin stacking apparatus shown in FIG. 13, corresponding to (a) a large-diameter coin and (b) a small-diameter coin.

Referring to FIG. 10, a third preferred embodiment of the present invention will be described below.

<Construction>

As shown in FIG. 10, this preferred embodiment is different from the above described first preferred embodiment in that a coin feeding belt 4A is provided as a coin feeding member in place of the above described coin feeding rollers 4, and other constructions are the same as those in the above described first preferred embodiment shown in FIGS. 1 through 8.

Specifically, as shown in FIG. 10, the above described feeding belt 4A extends between a set of upper and lower pulleys 44 and 46, and the lower pulley 46 is rotated by the above described driving system 5. A portion 48*a* of an outer surface 48 of the feeding belt 4A over a top end portion of the upper pulley 44 functions as a cylindrical rotating friction surface corresponding to the friction surfaces 40 of the feeding rollers 4.

Modified Example

From the same standpoint as that in the above described second preferred embodiment, in this preferred embodiment, any irregularities may be formed on the outer surface 48 of the coin feeding belt 4A.

Fourth Preferred Embodiment

Referring to FIGS. 11*a* through 12*b*, a fourth preferred embodiment of the present invention will be described below.

<Construction>

As shown in FIGS. 11*a* through 12*b*, this preferred embodiment is different from the above described first preferred embodiment in that the conventional toothed roller 140 is substituted for the feeding roller 4 as the coin feeding member, and other constructions are the same as those in the above described first preferred embodiment shown in FIGS. 1 through 8.

Above all, also in this preferred embodiment, distance A2 between an axis of the toothed roller 140 and stop surface 60 of stopping member 6 is adjustable in accordance with a diameter of coins. In addition, there is provided the same coin pressure mechanism 7 as that of the first preferred embodiment.

The toothed roller 140 has a plurality of circumferentially arranged tooth portions 142 as a contact portion. Each of the tooth portions 142 includes a push surface 144 being pressed by a leading edge of conveyed coin C, and a lifting surface 146 lifting a trailing edge of the coin C fed in stacking section 3.

<Functional Effects>

Functional effects of this preferred embodiment with such constructions will be described. According to this preferred embodiment, it is impossible to have the functional effects peculiar to the feeding roller 4 of the first preferred embodiment. However, similar to the first preferred embodiment, it is possible to have the functional effects provided by the adjustability of the distance A2 and the coin pressure mechanism 7 in particular. Thus, it is also possible to increase an adaptable range of diameters of coins.

Other Preferred Embodiments

While coins have been stacked substantially vertically upwards in the above described preferred embodiments, the present invention should not be limited thereto. That is, coins may be stacked substantially vertically downwards or substantially horizontally. As an example, a case where coins are stacked substantially vertically downwards will be described below.

That is, directions of the coin feeding members 4, 4', 4A or 140 and the coin stacking section 3 in the above described preferred embodiments are turned upside down and a pushing mechanism for pressing coins in the stacking section 3, upwards is provided in place of the presser mechanism 7. Thus, coins are stacked downwards by the same operation as that in the above described preferred embodiments while the uppermost coin is pressed against the contact portions 40, 40', 48*a* or 142 of the coin feeding members 4, 4', 4A or 140 by operation of the pushing mechanism.

The coin stacking section 3 should not be limited to the section surrounded by the three wrapping rollers R1, R2 and R3, but it may be a section surrounded by a plurality of rods or a section surrounded by substantially cylindrical structure, such as a circular cylinder or the like. The above described coin passage 1 should not be limited to a horizontal and/or straight passage, but it may be inclined or bent. The above described conveying device 2 should not be limited to including the belt 24, and may include a plurality of rollers or the like.

What is claimed is:

1. A coin stacking apparatus comprising:

a coin passage for guiding coins, in a row, in a direction of a diameter of the coins;

a conveying mechanism for conveying the coins along said coin passage;

a coin stacking section corresponding to an end portion of said coin passage;

a coin feeding member for sequentially stacking the coins, after having been conveyed by said conveying mechanism, in said coin stacking section in a stacking direction that generally corresponds to a thickness direction of the coins, said coin feeding member having a contact portion protruding into said coin stacking section, and said coin feeding member being configured to rotate with said contact portion contacting a conveyed coin so as to cause the conveyed coin to pass over said contact portion from an upstream side to a downstream side thereof with respect to a direction of rotation of said coin feeding member and thereby cause a trailing edge of the conveyed coin to be displaced in the stacking direction so that a leading edge of a subsequently conveyed coin is capable of entering between the conveyed coin and said contact portion upon rotation of said coin feeding member while said contact portion is in contact with the subsequently conveyed coin; and a stopping member on the downstream side of said contact portion, said stopping member having a stop surface for contacting a leading edge of the conveyed coin after the conveyed coin has passed over said contact portion, wherein a distance between an axis of rotation of said coin feeding member and said stop surface is adjustable in accordance with the diameter of the coins, and wherein positions of said coin feeding member and said stopping member relative to said coin passage are adjustable in horizontally longitudinal and lateral directions of said coin passage in accordance with the diameter of the coins with said coin feeding member and said stopping member positioned substantially on a center line of said coin passage.

2. The coin stacking apparatus according to claim 1, wherein the position of said coin feeding member relative to said coin passage is adjustable in longitudinal and lateral directions of said coin passage, in accordance with the diameter of the coins, by being simultaneously adjustable in the longitudinal and lateral directions of said coin passage.

3. The coin stacking apparatus according to claim 2, wherein said coin feeding member is for sequentially stacking the coins substantially vertically upward in said coin stacking section, and further comprising:

a coin presser mechanism for downwardly pressing, by dead weight, an upper surface of an uppermost one of the coins when stacked in said coin stacking section, said coin presser mechanism including a presser member movable in the stacking direction while contacting the upper surface of the uppermost one of the coins, and also including a weight member connected to said presser member via an elastic member.

4. The coin stacking apparatus according to claim 3, wherein said coin feeding member has a cylindrical friction surface as said contact portion.

5. The coin stacking apparatus according to claim 3, wherein said coin feeding member comprises a toothed roller having circumferentially arranged tooth portions as said contact portion, with each of said tooth portions including:

(i) a push surface for being pressed by a leading edge of the conveyed coin; and (ii) a lifting surface for lifting a trailing edge of the conveyed coin when fed into said coin stacking section.

6. The coin stacking apparatus according to claim 2, wherein said coin feeding member has a cylindrical friction surface as said contact portion.

7. The coin stacking apparatus according to claim 2, wherein said coin feeding member comprises a toothed roller having circumferentially arranged tooth portions as said contact portion, with each of said tooth portions including:

(i) a push surface for being pressed by a leading edge of the conveyed coin; and (ii) a lifting surface for lifting a trailing edge of the conveyed coin when fed into said coin stacking section.

8. The coin stacking apparatus according to claim 1, wherein said coin feeding member is for sequentially stacking the coins substantially vertically upward in said coin stacking section, and further comprising:

a coin presser mechanism for downwardly pressing, by dead weight, an upper surface of an uppermost one of the coins when stacked in said stacking section, said coin presser mechanism including a presser member movable in the coin stacking direction while contacting the upper surface of the uppermost one of the coins, and also including a weight member connected to said presser member via an elastic member.

9. The coin stacking apparatus according to claim 1, wherein said coin feeding member has a cylindrical friction surface as said contact portion.

10. The coin stacking apparatus according to claim 1, wherein said coin feeding member comprises a toothed roller having circumferentially arranged tooth portions as said contact portion, with each of said tooth portions including:

(i) a push surface for being pressed by a leading edge of the conveyed coin; and (ii) a lifting surface for lifting a trailing edge of the conveyed coin when fed into said coin stacking section.

11. A coin stacking apparatus comprising:

a coin passage for guiding coins, in a row, in a direction of a diameter of the coins;

a conveying mechanism for conveying the coins along said coin passage;

a coin stacking section corresponding to an end portion of said coin passage;

a coin feeding member for sequentially stacking the coins, after having been conveyed by said conveying mechanism, in said coin stacking section substantially vertically upwardly in a stacking direction that generally corresponds to a thickness direction of the coins, said coin feeding member having a contact portion protruding into said coin stacking section, and said coin feeding member being configured to rotate with said contact portion contacting a conveyed coin so as to cause the conveyed coin to pass over said contact portion from an upstream side to a downstream side thereof with respect to a direction of rotation of said coin feeding member and thereby cause a trailing edge of the conveyed coin to be displaced in the stacking direction so that a leading edge of a subsequently conveyed coin is capable of entering between the conveyed coin and said contact portion upon rotation of said coin feeding member while said contact portion is in contact with the subsequently conveyed coin; and a coin presser mechanism for downwardly pressing, only by dead weight of said coin presser mechanism, an upper surface of an uppermost one of the coins when stacked in said coin stacking section while conveyed coins are sequentially stacked therein, wherein said coin presser mechanism includes a presser member movable in the stacking direction while contacting the upper surface of the uppermost one of the coins, and also including a weight member connected to said presser member via an elastic member.

12. The coin stacking apparatus according to claim 11, wherein a position of said coin feeding member with respect to said coin passage is adjustable in accordance with the diameter of the coins.

13. The coin stacking apparatus according to claim 11, wherein said coin feeding member has a cylindrical friction surface as said contact portion.

14. The coin stacking apparatus according to claim 11, wherein said coin feeding member comprises a toothed roller having circumferentially arranged tooth portions as said contact portion, with each of said tooth portions including:

(i) a push surface for being pressed by a leading edge of the conveyed coin; and (ii) a lifting surface for lifting a trailing edge of the conveyed coin when fed into said coin stacking section.

* * * * *